US009321619B2

(12) United States Patent
Wang et al.

(10) Patent No.: US 9,321,619 B2
(45) Date of Patent: Apr. 26, 2016

(54) MULTI-AXIS LOAD GRIPPING ARM

(75) Inventors: Qinglin Wang, Xiamen (CN); Hailong Lin, Xiamen (CN)

(73) Assignee: Cascade Corporation, Fairview, OR (US)

( * ) Notice: Subject to any disclaimer, the term of this patent is extended or adjusted under 35 U.S.C. 154(b) by 516 days.

(21) Appl. No.: 13/618,051

(22) Filed: Sep. 14, 2012

(65) Prior Publication Data

US 2013/0071211 A1 Mar. 21, 2013

(30) Foreign Application Priority Data

Sep. 16, 2011 (CN) ..... 2011 2 0348166 U

(51) Int. Cl.
*B66F 9/18* (2006.01)

(52) U.S. Cl.
CPC ..... *B66F 9/183* (2013.01); *B66F 9/188* (2013.01)

(58) Field of Classification Search
CPC ..... B60F 9/183; B60F 9/188; B60F 9/184; B60F 9/187; B60F 9/125; B60F 9/18; Y10S 294/902; B25J 15/0028; B25J 15/0253
USPC ..... 414/621, 623, 618, 785, 931, 664, 665, 414/670, 620; 294/62, 63.1, 63.2; 901/45
See application file for complete search history.

(56) References Cited

U.S. PATENT DOCUMENTS 1,807,360 A * 5/1931 Wehr ..... 294/106
2,674,387 A * 4/1954 Ehmann ..... 414/621
2,681,162 A * 6/1954 Ehmann ..... 414/621
2,782,065 A * 2/1957 Lord ..... 294/87.1
2,782,066 A * 2/1957 Lord ..... 294/99.1
2,884,403 A * 4/1959 Zorn et al. ..... 525/473
2,989,201 A * 6/1961 Hansen ..... 414/623
3,203,567 A * 8/1965 Huitfeldt ..... 414/620
3,370,880 A * 2/1968 Carliss et al. ..... 294/87.1
3,448,880 A * 6/1969 Howard ..... 414/607
3,549,192 A * 12/1970 Cassady ..... 294/106
3,971,585 A * 7/1976 LaBudde ..... 294/207
3,982,782 A * 9/1976 Bos ..... 294/189
4,331,320 A * 5/1982 Naruse et al. ..... 254/2 R
7,118,148 B1 * 10/2006 Davis ..... 294/119.1
2003/0021667 A1 1/2003 Harrell
2004/0115035 A1 6/2004 Tygard

FOREIGN PATENT DOCUMENTS

CN 202046845 11/2011
CN 202046850 11/2011
EP 0032449 7/1981
EP 0384044 8/1990
GB 812990 5/1959
GB 1563494 3/1980

OTHER PUBLICATIONS

International Search Report and Written Opinion mailed Dec. 17, 2012, PCT/US2012/055646, filed Sep. 14, 2012, Cascade Corporation, 8 pgs.

* cited by examiner

*Primary Examiner* — Saul Rodriguez
*Assistant Examiner* — Mark Hageman
(74) *Attorney, Agent, or Firm* — Chernoff Vilhauer McClung & Stenzel, LLP

(57) ABSTRACT

A gripping arm for a clamping attachment for a forklift has a load engaging inner arm including portions defining a load face. The inner arm is pivotal about a first axis parallel to the load face and pivots about a second axis normal to the first axis to engage and secure a load.

17 Claims, 5 Drawing Sheets

MULTI-AXIS LOAD GRIPPING ARM

TECHNICAL FIELD

The present disclosure relates to an attachment for a forklift truck, and in particular relates to a gripping arm for a load clamping attachment mountable on a forklift.

BACKGROUND ART

Forklift truck attachments comprise a variety of devices and tools for realizing multiple functions from a single forklift. Convenient installation and removal of different working attachments allows a forklift to adapt to a variety of conditions. Forklift attachments enhance the work efficiency and safety performance of the forklift, and are also an important means of significantly reducing damage to the loads being handled. For example, the use of a paper roll clamp to move paper rolls can minimize or avoid damage to paper rolls; if using a forklift not equipped with a paper roll clamp, the incidence of damage to paper rolls can increase by 15%. For packaging enterprises which use large quantities of paper or use high quality paper, the investment in such an attachment will be recovered in just a short period of time, and the subsequent avoidance of the 15% damage rate can greatly lower the production costs of the enterprise. The use of a fork positioner enables the driver to adjust the fork-to-fork distance as required from the seat via a control lever, thus improving work efficiency, reducing labor, and avoiding damage to the pallet and finger injuries during adjustment. The use of push/pulls for transporting materials with an inexpensive slip sheet instead of a pallet and saves on pallet maintenance and stacking-related expenses. Particularly when stacking loads inside containers and rail cars, stacking space is more efficiently conserved. It may be seen that forklift attachments play an important role in fully utilizing the functions of the forklift truck.

Clamps are a type of forklift attachment that can safely and efficiently clamp various stone and brick materials, and are suited to palletless moving and stacking operations in the floor tile, concrete preform, masonry and graphite, etc. industries. They are typically composed of a rear mounting system, a left gripping arm, a right gripping arm and a hydraulic system. The rear mounting system connects the entire attachment to the forklift. The left and right arms are equipped with rubber blocks. The hydraulic system functions to generate frictional force when the left and right arms clamp a load, balancing the gravitational force of the load, so as to achieve the function of transporting the same.

The structure of current gripping arms is typically constituted by an outer arm, an inner arm and a pin. The inner arm is equipped with a single rubber block, while the pin, gaskets and outer arm together form a horizontal hinge structure which is further provided with limiting members at both ends. In practice, the horizontal adjustment range is limited, and there is no mechanism allowing adjustment in the vertical direction, such that loads cannot be evenly borne, and are prone to sliding off and sustaining damage. In addition, the use of a single rubber block imposes height restrictions, and tall loads are unable to be effectively stabilized, while repairs and maintenance are difficult once the entire block becomes worn. What is desired, therefore, is clamp attachment mountable on a forklift which provides improved load stability and reduces the cost and difficulty of maintaining the gripping arms.

SUMMARY OF THE DISCLOSURE

To provide a load gripping arm for a forklift truck which evenly distributes load stress and affords steady and reliable clamping, the present gripping arm comprises an outer arm, a balance arm, an inner arm, and a rubber block. The rubber block is mounted on the inner surface of the inner arm. Mounting holes for the inner arm are disposed along the horizontal direction of the outer surface of the inner arm. A horizontal through-hole is provided along the horizontal direction of the balance arm, and on one side of the horizontal through-hole is provided a vertical through-hole. The balance arm can be mounted to swing vertically on the inner arm mounting holes by means of a horizontal pin passing through the balance arm horizontal through-hole, and the balance arm can be mounted to swing horizontally on a vertical through-hole of the outer arm by means of a vertical pin passing through the vertical through-hole of the balance arm.

The rubber block is composed of a plurality of small rubber blocks, which are fixed on the inner surface of the inner arm by means of bolts.

After adopting the foregoing solution, the gripping arm is primarily composed of the outer arm, a balance arm, and an inner arm. The addition of such a balance arm enables the gripping arm to possess the following advantages relative to conventional gripping arms:

1. Owing to the addition of a balance arm in the present utility model, the balance arm can swing horizontally with respect to the outer arm, and swing vertically with respect to the inner arm, thereby enabling vertical adjustment, improving the structure of the gripping arm, and expanding the range of adjustment in the horizontal direction. An automatic bidirectional adjustment effect is thus achieved, allowing for balanced bearing of a load, and preventing portions of the same from sliding off and sustaining damage.

2. The rubber block in the present gripping arm is composed of a plurality of small rubber blocks, which are bolted to the inner arm. Firstly, this enables clamping of smaller brick-like materials, expanding the scope of use of the attachment. Secondly, once the rubber block begins to wear, it can be partially replaced without needing to replace the entire block as required previously, thus reducing customer maintenance costs. Thirdly, securing the blocks with a bolt renders assembly and disassembly more convenient, significantly shortening the time spent on attachment repairs and maintenance.

3. The adoption of a double-layer or multi-layer rubber block for the present gripping arm can ameliorate the stress between the attachment and the load, while also enabling effective stabilization for tall loads and preventing loads sliding off the upper layer during accidental collisions, making material handling safer.

4. The structure of the gripping arm according to the present utility model enhances adjustment performance in the horizontal direction without compromising structural strength and rigidity. At the same time, the balance arm hinge enhances the ability of the attachment to automatically adjust in the vertical direction. In addition, the middle of the gripping arm is grooved, which in one aspect can reduce the weight of the attachment, improving its carrying capacity, and in another aspect can increase the field of view of the operator, which is advantageous to operational reliability.

What follows incorporates the accompanying drawings and specific embodiments to further illustrate the novel present gripping arm.

DETAILED DESCRIPTION OF SPECIFIC EMBODIMENTS

Figure 1:
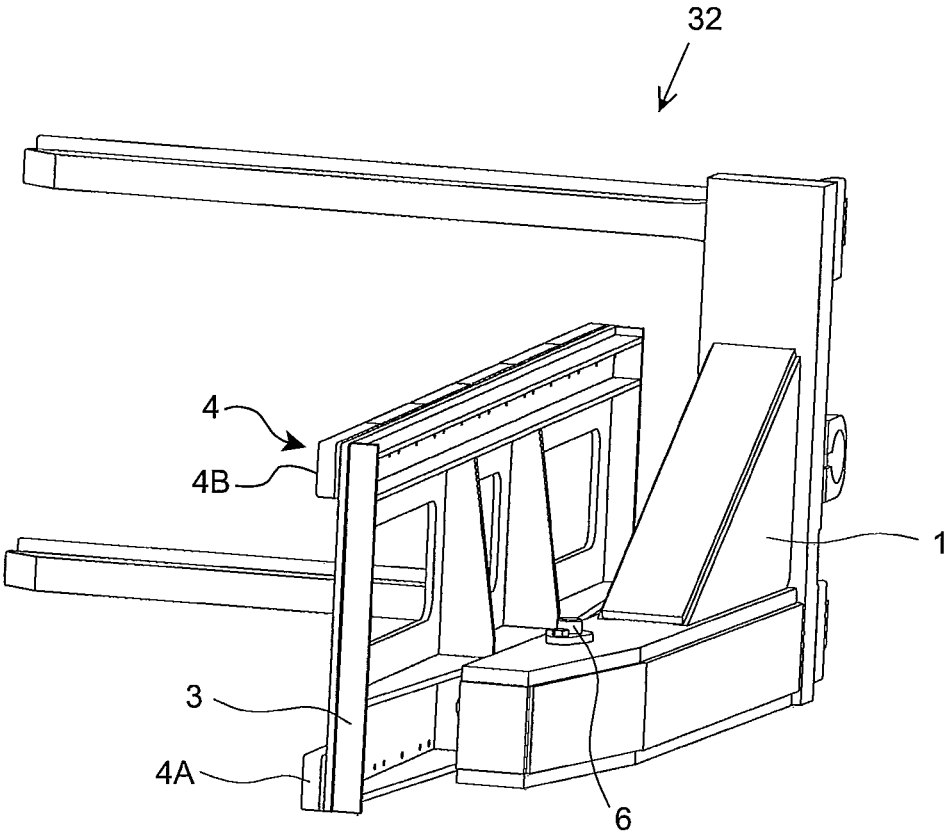
FIG. 1 is an axonometric view of a gripping arm for a clamping attachment mountable on a forklift.
Figure 2:
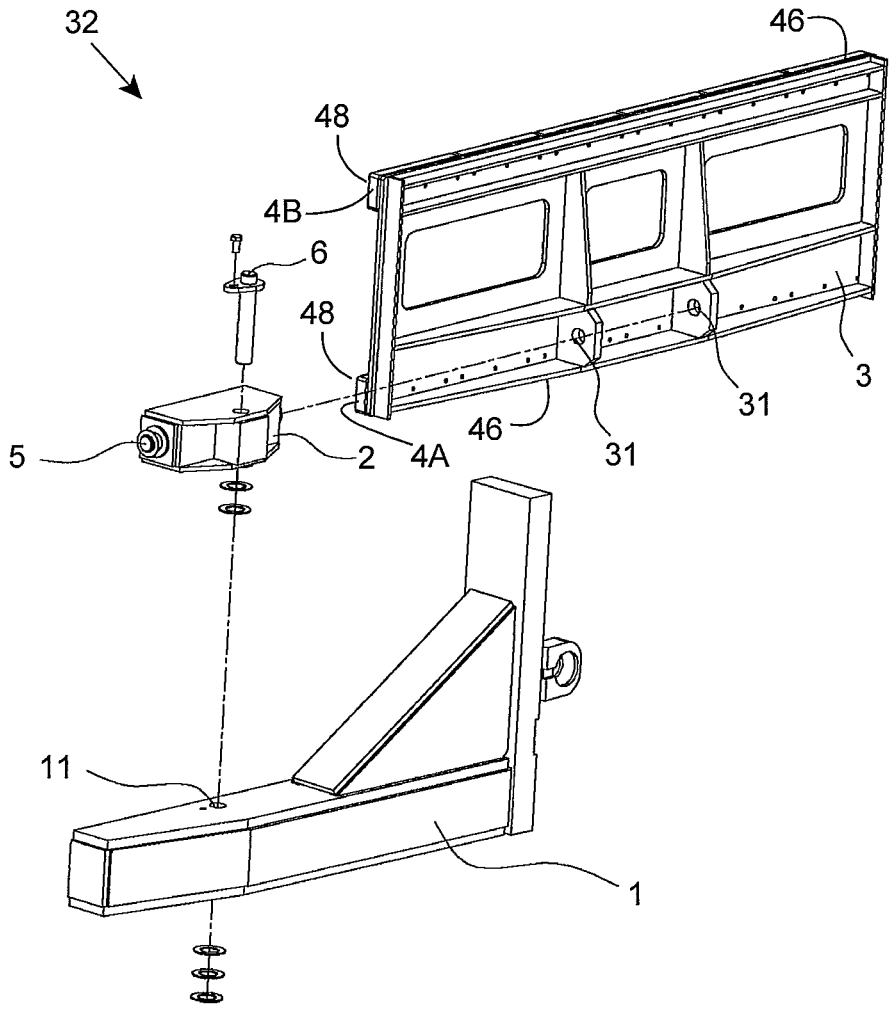
FIG. 2 is a three-dimensional exploded view of the gripping arm of FIG. 1.
Figure 6:
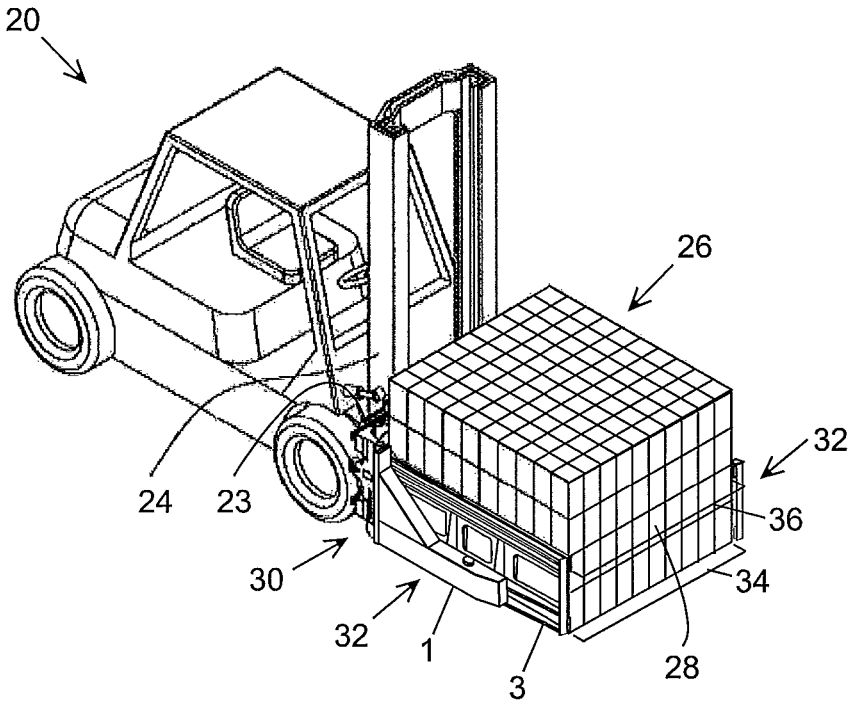
FIG. 6 is a perspective view of a forklift truck equipped with a clamping attachment which includes the gripping arm of FIG. 1.

Referring to FIG. 6, a forklift truck 20 (also called a lift truck, a fork truck, or a forklift) is a powered industrial truck used to lift and transport materials. A load to be lifted and transported is engaged and supported by a load engaging device which is typically attached to a rear mounting system or carriage 23 arranged to be raised, lowered and tilted in a mast 24. A basic load engaging device for a forklift is a pair of forks or load arms each comprising a vertical bar or shank attachable to the carriage and a horizontal shank projecting normal to the vertical shank to engage the lower surface of a load. However, many forklifts are equipped, or can be equipped, with one or more attachments to facilitate efficient handling of certain loads. For example, if a load is to be supported by the forks of a forklift the lower surface of the load must be unitary but composite loads, such as the exemplary load 26, comprising a plurality of smaller objects 28, such bricks or concrete blocks, do not have unitary lower surfaces that can support the load when engaged by the narrow horizontal shanks of a pair of forks. If a composite load is to be handled with forks, it is typically placed on a pallet to provide a unitary lower surface for supporting the load, but this increases the cost of load handling and the pallet can consume valuable storage space. The forklift 20 is equipped with a clamping attachment 30 which is attached to the carriage 23, or which includes an integral carriage, and which is arranged to move a pair of load gripping arms 32 toward each other, to clamp a load or a portion of a load therebetween. By increasing friction between the objects making up a composite load and, more particularly, the objects making up a bottom layer of a composite load, for example, the bottom layer 34 (indicated by a bracket) of the exemplary composite load 26, the load clamping attachment unitizes the bottom surface of the load enabling the composite load to be lifted and transported without a pallet or other secondary support means. As shown in FIGS. 1 and 2, each gripping arm 32 of the clamping attachment 30 comprises an outer arm 1 including a portion projecting from the forklift in the direction of the load to be engaged, a balance arm 2, an inner arm 3, a rubber block 4, a horizontal pin 5, and a vertical pin 6.

Figure 4:
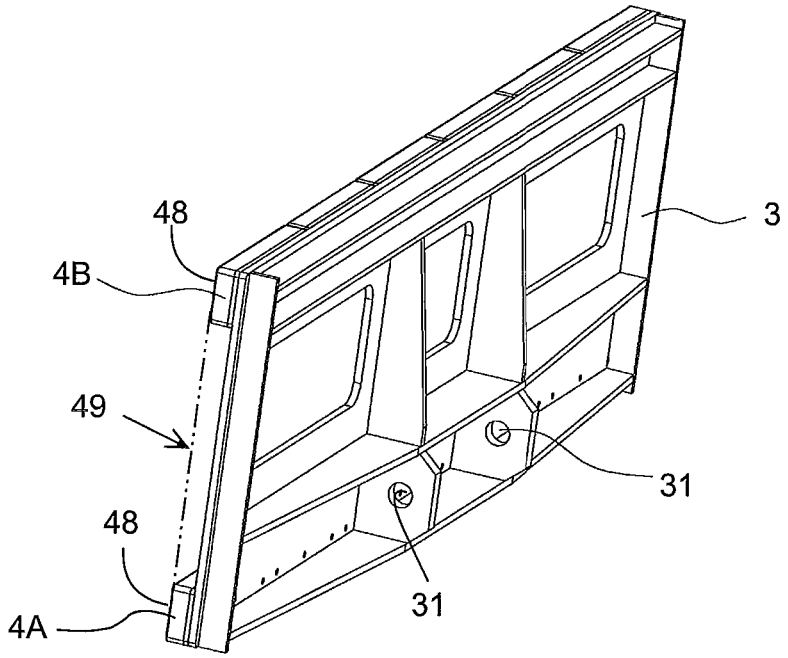
FIG. 4 is an axonometric view of the inner arm of the gripping arm of FIG. 1.
Figure 5:
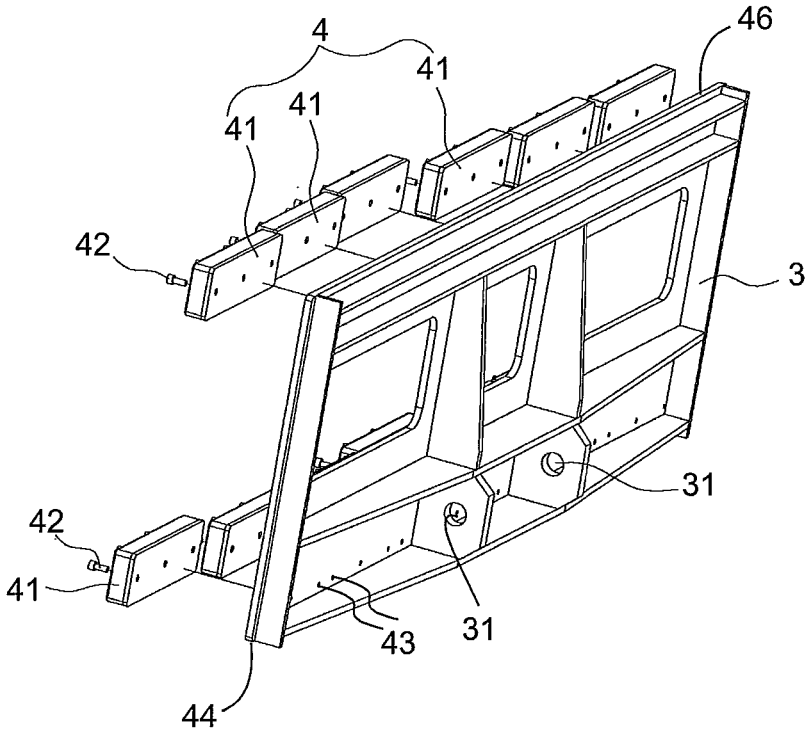
FIG. 5 is a schematic view of the assembly of the inner arm and rubber blocks of FIG. 4.

As shown in FIGS. 4 and 5, the elongate rubber block 4 comprises a plurality of small rubber blocks 41, the small rubber blocks 41 being fixed to the inner surface 40 of the inner arm 3 by means of a bolt 42. Preferably, mounting holes 43 are provided proximate the opposing upper 46 and lower 44 edges of the inner arm 3 enabling attachment of a plurality of small rubber blocks 41 to form an elongate rubber block 4A proximate the lower edge of the inner arm and an elongate rubber block 4B distal of the lower edge and, more preferably, proximate the upper edge of the inner arm. The surfaces 48, distal of the inner surface 40 of the inner arm 3 to which the rubber blocks 4A and 4B are mounted, preferably define a plane 49 and comprise the load face of the gripping arm, the portions of the gripping arm that engage the load being clamped. Mounting holes 31 for mounting the inner arm are provided along the horizontal direction of the outer surface of the inner arm 3.

Figure 3:
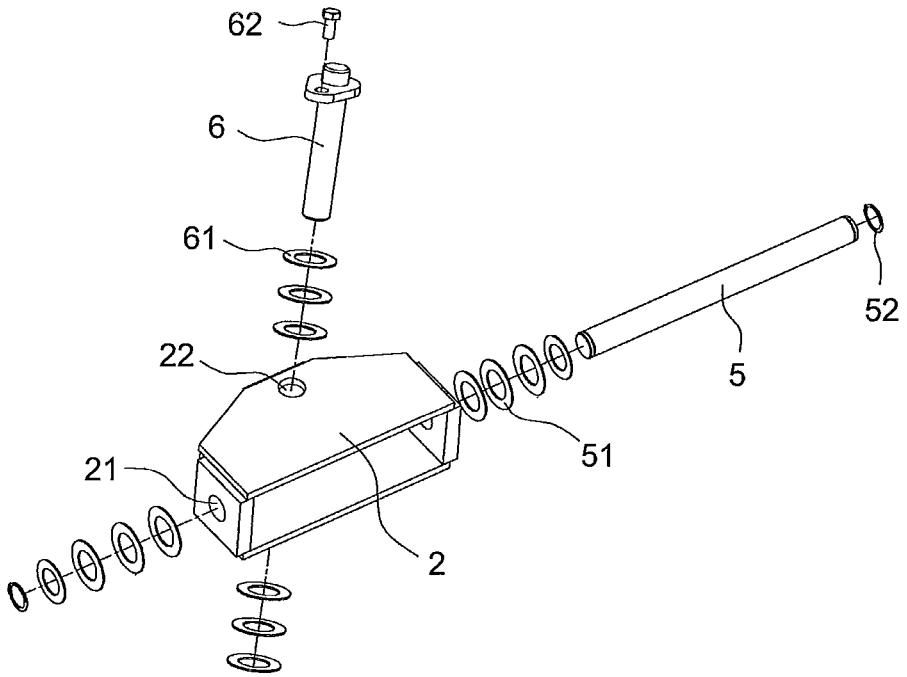
FIG. 3 is a three-dimensional exploded view of the balance arm of the gripping arm of FIG. 1.

As shown in FIG. 3, a horizontal through-hole 21 is provided along the horizontal direction of the balance arm 2, and, along the vertical direction on one side of the horizontal through-hole 21, is provided a vertical through-hole 22. The balance arm 2 can be mounted to swing vertically, that is, on an axis substantially parallel to the load face(s) 48 defined by the rubber blocks 4A and 4B, on the inner arm 3 mounting holes 31 by means of a horizontal pin 5 passing through the balance arm horizontal through-hole 21 (as shown in FIG. 2), and secured with gaskets 51 and retaining ring 52. The balance arm 2 can be mounted to swing horizontally, that is, on an axis normal to the axis of the horizontal pin 5, on a vertical through-hole 11 of the outer arm 1 by means of a vertical pin 6 passing through the balance arm vertical through-hole 22 (as shown in FIG. 2), and secured with gaskets 61 and a bolt 62.

As FIG. 2 shows, once assembly is complete, the inner arm 3 and the balance arm 2 can rotate in the vertical direction, that is, the inner arm can pivot on a first axis parallel to the longitudinal axis of the load face 48 of the rubber block 4A, about horizontal pin 5 while the inner arm 3 and the balance arm 2 can rotate in the horizontal direction, that is the inner arm 3 can pivot on a second axis substantially normal to the first axis and generally parallel to the plane 49 defined by the load faces 48 of the lower rubber block 4A and the upper rubber block 4B, about the vertical pin 6. As a load is clamped, automatic bidirectional adjustment can be achieved, ensuring the load stress is evenly borne. Furthermore, the vertical rotation, that is, rotation of the inner arm 3 about the horizontal pin 5, can act to provide effective contact between the upper rubber block 4B and a second layer of the load, for example the layer 36 (indicated by a bracket) of load 26, improving the load bearing performance of the attachment.

The focus of the present disclosure lies in the addition of a balance arm permitting the inner arm of the gripping arm to adjust on multiple axes.

The foregoing is merely a preferred embodiment of the gripping arm; the assembly of the balance arm may take a variety of forms, such that the scope of the present disclosure is not restricted thereto. Equivalent changes and embellishments made according to the Claims and Description of the present disclosure still fall under the scope of the disclosure.

What is claimed is:

1. A gripping clamp for a forklift truck, the clamp comprising:

(a) a first gripping arm including a first elongate block arranged to engage an elongate lower portion of a load, a longitudinal axis of said first block approximately parallel to a bottom surface of said load, and a second elongate block spaced apart from said first block in a direction normal to said longitudinal axis of said first block and arranged to engage a second elongate portion of said load more distant from said bottom surface of said load than any part of said lower portion, said first block and said second block fixedly defining a plane and arranged to pivot about said longitudinal axis of said first block and to pivot about a second axis substantially normal to said longitudinal axis of said first block and parallel to said plane defined by said first block and said second block; and (b) a second gripping arm including a third elongate block arranged to engage an elongate second lower portion of said load, a longitudinal axis of said third block approximately parallel to said bottom surface of said load, and a fourth elongate block spaced apart from said third block in a direction normal to a longitudinal axis of said third block and arranged to engage another elongate portion of said load more distant from said bottom surface of said load than any part of said second lower portion, said third block and said fourth block fixedly defining a plane and arranged to pivot about said longitudinal axis of said third block and to pivot about an axis substantially normal to said longitudinal axis of said third block and parallel to said plane defined by said third block and said fourth block; wherein said first gripping arm and said second gripping arm are movable together to clamp a load between said elongate blocks.

2. The clamp of claim 1 wherein at least one of said first block, said second block, said third block and said fourth block comprises a plurality of rubber blocks fixed on a surface of an arm by means of a bolt.

3. A load gripping arm for a forklift mountable clamping attachment, the load gripping arm comprising an inner arm having an elongate first load face portion movable to engage a lower portion of a load proximate a bottom surface of the load and a second load face portion spaced apart in a direction normal to a longitudinal axis of the first load face portion and fixedly arranged substantially coplanar with the first load face portion, the second load face portion engageable only with portions of the load more distal of the bottom surface of the load than any portion of the load engageable by the first load face portion, the inner arm arranged to pivot about a first axis parallel to the longitudinal axis of the first load face portion and arranged to pivot about an axis normal to the first axis and generally parallel to the plane of the first load face portion and the second load face portion.

4. The load gripping arm of claim 3 wherein at least one of the first load face portion and the second load face portion comprises a surface of a block attached to the inner arm.

5. The load gripping arm of claim 4 wherein the block comprises rubber.

6. The load gripping arm of claim 4 wherein the block comprises a plurality of blocks respectively attached to the inner arm.

7. The load gripping arm of claim 3 further comprising:

(a) an outer arm movably securable to a forklift; and (b) a balance arm secured to the inner arm and arranged to pivot relative to the inner arm about the first axis extending substantially parallel to said first load face portion and secured to the outer arm and arranged to pivot relative to the outer arm about the second axis extending substantially normal to the first axis.

8. The load gripping arm of claim 3 further comprising:

(a) an outer arm movably securable to a forklift; and (b) a balance arm pivotally secured to the inner arm by first pin having a longitudinal axis extending substantially parallel to the first load face portion and pivotally secured to the outer arm by a second pin having a longitudinal axis normal the longitudinal axis of the first pin.

9. A load gripping clamp for a forklift truck, the clamp comprising:

(a) a first load gripping arm; and (b) a second load gripping arm movable toward the first load gripping arm to clamp a load therebetween, the first load gripping arm and the second load gripping arm each comprising:

(i) an elongate first load face portion arranged to engage a lower portion of a load proximate a bottom surface of the load to be clamped; and (ii) an elongate second load face portion fixedly arranged substantially coplanar with and spaced apart from the first load face portion in a direction normal to a longitudinal axis of the first load face portion to engage another portion of the load to be clamped, all of said other portion of said load more distant from the bottom surface of the load than any part of the lower portion engageable by the first load face portion, the first load face portion arranged to pivot about a first axis approximately normal to the longitudinal axis of the first load face portion and substantially parallel to the plane defined by the first load face portion and the second load face portion and to pivot about a second axis substantially coincident to the longitudinal axis of the first load face portion.

10. The load gripping clamp of claim 9 wherein the first load face portion and the second load face portion of each of the first gripping arm and the second gripping arm comprise surfaces of plural elongate blocks affixed to, respectively, a first inner arm and a second inner arm.

11. The load gripping clamp of claim 10 wherein at least one of the plural elongate blocks comprises rubber.

12. The load gripping clamp of claim 10 wherein at least one of the plural blocks comprises a plurality of block portions each respectively attachable to one of the first inner arm and the second inner arm.

13. The load gripping clamp of claim 9 wherein the first load gripping arm and the second load gripping arm each further comprise:

(a) an outer arm movably securable to a forklift and including an elongate first portion extending from the forklift in a direction of a load to be clamped by the load gripping clamp;

(b) a balance arm secured to the outer arm and arranged to pivot relative to thereto about the first axis extending substantially normal to a longitudinal axis of the first portion of the outer arm; and (c) an inner arm secured to the first load face portion, the second load face portion and the balance arm and arranged to pivot relative to the balance arm about the second axis extending substantially parallel to the first load face portion.

14. The load gripping clamp of claim 13 wherein the first load face portion and the second load face portion secured to the first inner arm each comprise surfaces of plural elongate blocks.

15. The load gripping clamp of claim 14 wherein at least one of the plural elongate blocks comprises rubber.

16. The load gripping clamp of claim 14 wherein at least one of the plural blocks comprises a plurality of block portions each respectively attachable to the inner arm.

17. The load gripping clamp of claim 16 wherein at least one of the plural block portions comprises rubber.

* * * * *